United States Patent [19]

Ohkita et al.

[11] 4,314,118

[45] Feb. 2, 1982

[54] SWITCH HAVING A COIL SPRING AND METHOD OF ASSEMBLING

[75] Inventors: Masao Ohkita; Hitoshi Yamashita, both of Furukawa, Japan

[73] Assignee: Alps Electric Co., Ltd., Tokyo, Japan

[21] Appl. No.: 919,800

[22] Filed: Jun. 28, 1978

[30] Foreign Application Priority Data

Jun. 28, 1977 [JP] Japan ..... 52-76797

[51] Int. Cl.[3] ..... H01H 15/02; H01H 11/00

[52] U.S. Cl. ..... 200/16 F; 29/622; 200/16 D

[58] Field of Search ..... 200/16 C, 16 D, 16 F; 29/622, 756, 764

[56] References Cited

U.S. PATENT DOCUMENTS

| | | | |
|---|---|---|---|
| 2,846,533 | 8/1958 | Spicer, Jr. | 200/61.27 |
| 2,902,550 | 9/1959 | Allison | 200/16 F |
| 3,476,891 | 11/1969 | Lis | 200/16 F |
| 3,614,347 | 10/1971 | Castle | 200/16 D |
| 3,673,365 | 6/1972 | Schadow | 200/16 D X |
| 3,844,012 | 10/1974 | Sturtevant | 29/764 X |
| 4,006,526 | 2/1977 | Vidalin | 29/622 |

*Primary Examiner*—James R. Scott

*Attorney, Agent, or Firm*—Guy W. Shoup; Gerard F. Dunne

[57] ABSTRACT

A spring loaded switch which includes a coil spring having hook portions provided at respective ends thereof is first fastened to respective catch portions provided inside the switch frame. Thereafter a slider member having a vertical projection is inserted in the frame so that the projection is opposed to one of the hook portions, whereupon the one hook portion can be removed from the catch portion with which it has been engaged, and onto the projection so that the coil spring now urges the slider member in one direction. Since a coil spring can be fastened to the switch frame first as mentioned above, the coil spring can be thereafter handled very easily.

4 Claims, 7 Drawing Figures

Fig.3
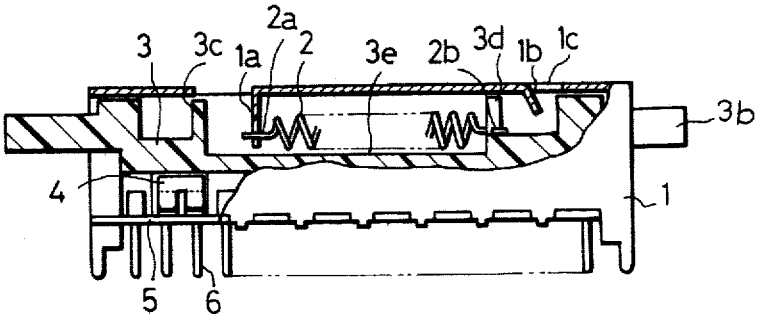
Fig. 4
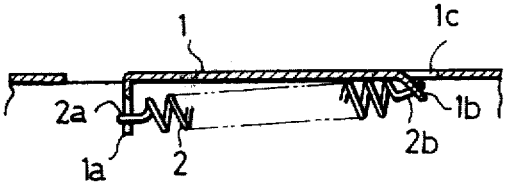
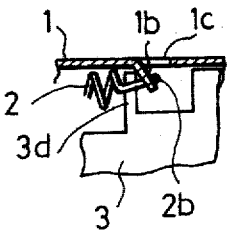
FIG. 5A
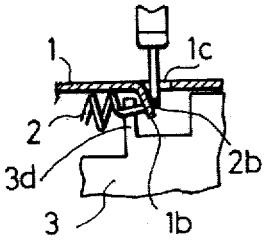
FIG .5B
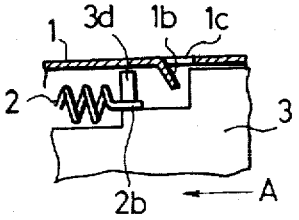
FIG. 5C

SWITCH HAVING A COIL SPRING AND METHOD OF ASSEMBLING

BACKGROUND OF THE INVENTION

1. Field of the Invention

The present invention relates to spring loaded switches and a method of assembling and, more particularly, to switches in which a coil spring urging a sliding member of the switch in one direction may be assembled in a highly cost effective manner so as to reduce the production costs of such switches.

2. Description of the Prior Art

There are various kinds of conventional switches in which a coil spring urges a sliding member of the switch in a particular direction. One kind of such switches includes a tension coil spring mounted in a frame. In this kind of switch, however, it is quite difficult to mount the coil spring properly in the frame and thus this kind of switch typically has a very poor production efficiency.

SUMMARY OF THE INVENTION

An object of the present invention is to eliminate the above-mentioned disadvantages of the prior art so as to enable production of a switch at reduced cost.

To this end, according to the present invention, there is provided a spring loaded switch which includes a coil spring having hook portions provided at respective ends so that it can first be fastened to catch portions provided inside the switch frame 1. A slider member having a vertical projection can then be inserted in the frame so that the projection is opposed to a hook portion of the spring. Thereafter the hook portion can be removed easily from the catch portion and onto the projection so that the coil spring now urges the slider member in one direction.

The above and other objects as well as advantageous features of the invention will become apparent from the following description of the preferred embodiment taken in conjunction with the accompanying drawings.

BRIEF DESCRIPTION OF THE DRAWINGS

FIG. 3 is a cross-sectional side view of principal portions of the switch shown in FIG. 1; and FIGS. 4, 5A, 5B and 5C show the mounting of the coil spring of the switch.

DESCRIPTION OF THE PREFERRED EMBODIMENT

Figure 1:
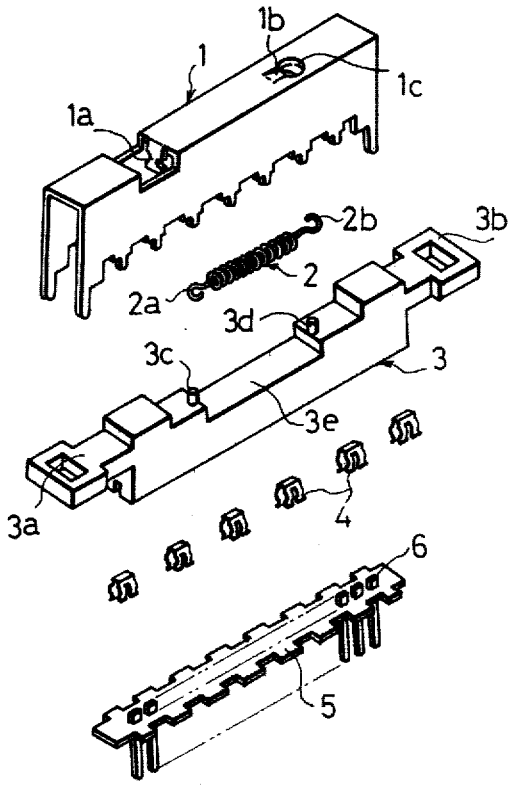
FIG. 1 is an exploded view of a switch of the present invention.
Figure 2:
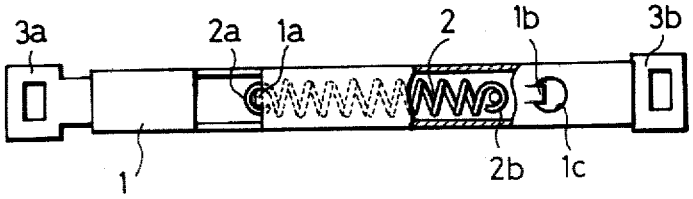
FIG. 2 is a plan view, partly broken away, of the switch shown in FIG. 1.

Referring to the drawings, a frame 1 which may be made by punching a metal sheet and bending the punched metal sheet into a substantially U-shaped form, has at the upper wall portion thereof a catch portion 1*a* inwardly bent at about 90° and a catch portion 1*b* inwardly bent at about 45°. The catch portion 1*b* extends under a generally circular opening 1*c* provided in the upper wall portion of the frame. Reference numeral 2 denotes a tension coil spring having hook portions 2*a* and 2*b* at the ends thereof. A slider member 3 made, for example, of an electrically insulating synthetic resin, has control portions 3*a* and 3*b*; a projecting portion 3*c* and a projecting portion 3*d* to which the hook portion 2*b* of the coil spring 2 can be fastened as will be described further below; and a recess 3*e* for receiving the coil spring 2. Reference numeral 4 denotes movable contact members, and 5 an insulative base plate onto which a plurality of terminals 6 are fixed. As will be well understood by those skilled in the art, movement of the slider member 2 results in selective engagement between various movable contact members 4 and the terminals 6. The assembly of the switch will be described below.

First, the coil spring 2 is inserted into the frame 1 with the hook portion 2*b* of the coil spring fastened to the catch portion 1*b* of the frame 1, and the hook portion 2*a* of the coil spring is fastened to the catch portion 1*a* of the frame 1, so that the coil spring 2 is fixed under tension inside the frame 1 (refer to FIG. 4). The slider member 3 is then inserted into the frame 1 in such a manner that the projection 3*d* is adjacent to the hook portion 2*b* of the coil spring 2 (refer to FIG. 5A). Then, the base plate 5 carrying the movable contact members 4 is secured to the frame 1 and held there by the mounting legs of the frame 1 in a manner that is well known.

Thereafter, when the hook portion 2*b* of the coil spring 2 is downwardly pushed (refer to FIG. 5B) with a rod or similar tool inserted through the circular opening 1*c* in the frame 1, the hook portion 2*b* is disengaged from the catch portion 1*b* and becomes engaged about the projection 3*d* of the slider member 3. At this time, the coil spring 2 is positioned in the recess 3*e* in the slider member 3, which has moved in the direction of the arrow A, due to the tension of the coil spring 2, to a position where a control portion 3*b* comes in contact with the edge portions of frame 1 (refer to FIG. 3). Thus, the assembling of the switch is completed.

According to the present invention, a coil spring can be fastened to the frame first in the manner as mentioned above. This allows the coil spring to be handled easily. Namely, the coil spring may be fastened to a predetermined portion of the frame very easily. In fact, the present invention permits providing low-priced switches having an improved assembling efficiency.

The present invention is not, of course, limited to the above-described embodiment; it may be modified in various ways within the scope of the appended claims. For example, one skilled in the art could easily adopt the teachings of the present invention to any number of kinds of spring loaded switches.

What is claimed is:

1. A method of assembling a spring loaded switch having a frame member carrying a plurality of fixed contacts and having a first catch portion adapted to hold a first end portion of a coil spring, and a slider member carrying movable contacts and adapted to slide within said frame member for engaging selectively said fixed contacts upon movement of said slider member, said slider member being adapted to hold the second end portion of said coil spring, said method comprising the steps of:

inserting said coil spring into said frame so as to hold one end portion of said spring by said first catch portion and the other end portion of said spring by a second catch portion of said frame, said coil spring being held under tension between said catch portions;

inserting said slider member into said frame; and thereafter removing one end portion of said spring from its associated catch portion and securing it into engagement with said slider member.

2. The method of claim 1, wherein said frame has an opening aligned with said second catch portion through which a tool can be inserted to remove said one end portion from said second portion and into engagement with said slider member.

3. A switch comprising:

a frame carrying a plurality of fixed contacts and having first and second catch portions extending inwardly from a wall portion of said frame;

a tension coil spring having a respective hook portion on each end thereof, one of said hook portions being held by said first catch portion;

a slider member carrying movable contacts and adapted to slide within said frame member for engaging selectively said fixed contacts upon movements of said slider member, said slider member having a projection adapted to engage the other of said hook portions to hold said spring under tension; and an opening in said frame adjacent said second catch portion whereby during assembly of said switch, said coiled spring may be first held under tension by engaging its hook portions about respective catch portions of said frame and then a tool can be inserted through said opening to remove said other hook portion from the second catch portion and onto said projection for securing said spring under tension between said frame and said slider member.

4. A switch according to claim 3, said first catch portion extending downwardly from the upper portion of said frame and said second catch portion also extending downwardly from said upper portion but angling away from said first catch portion.

* * * * *